US011623272B2

(12) United States Patent
Rotmann et al.

(10) Patent No.: US 11,623,272 B2
(45) Date of Patent: Apr. 11, 2023

(54) CASTING TOOL AND METHOD FOR PRODUCING A PISTON FOR AN INTERNAL COMBUSTION ENGINE

(71) Applicant: Mahle International GmbH, Stuttgart (DE)

(72) Inventors: Udo Rotmann, Marburg (DE); Juergen Gaissert, Leonberg (DE); Martin Ruehle, Stuttgart (DE)

(73) Assignee: Mahle Inernational GmbH

( * ) Notice: Subject to any disclaimer, the term of this patent is extended or adjusted under 35 U.S.C. 154(b) by 681 days.

(21) Appl. No.: 15/505,096

(22) PCT Filed: Jul. 21, 2015

(86) PCT No.: PCT/EP2015/066598
§ 371 (c)(1),
(2) Date: Feb. 19, 2017

(87) PCT Pub. No.: WO2016/026638
PCT Pub. Date: Feb. 25, 2016

(65) Prior Publication Data

US 2018/0361470 A1 Dec. 20, 2018

(30) Foreign Application Priority Data

Aug. 20, 2014 (DE) ..... 10 2014 216 517.2

(51) Int. Cl.
*B22D 15/02* (2006.01)
*B22C 9/08* (2006.01)
(Continued)

(52) U.S. Cl.
CPC ..... *B22D 15/02* (2013.01); *B22C 9/088* (2013.01); *B22D 25/02* (2013.01); *B22D 27/13* (2013.01)

(58) Field of Classification Search
CPC ... B22C 9/06–068; B22C 9/088; B22D 15/02; B22D 25/02; B22D 19/0027
See application file for complete search history.

(56) References Cited

U.S. PATENT DOCUMENTS 3,566,952 A * 3/1971 Lane ..... B22C 9/088 164/285
4,491,168 A * 1/1985 Snee ..... B22D 27/00 164/112
(Continued)

FOREIGN PATENT DOCUMENTS

CN 203900447 U 10/2014
DE 3200641 A1 8/1982
(Continued)

OTHER PUBLICATIONS

Google Translation of JP H03-47640 U (1991). . (Year: 1991).*
(Continued)

*Primary Examiner* — Kevin E Yoon
*Assistant Examiner* — Jacky Yuen
(74) *Attorney, Agent, or Firm* — Fishman Stewart PLLC

(57) ABSTRACT

A casting tool for a piston may include a casting mold for forming a piston part from a casting melt and a casting head including a feeder for feeding the casting melt into the casting mold. The casting head may include a ring-shaped groove, and the groove may include an inner groove flank for forming the casting melt into a circumferential, ring-shaped sealing rib such that an inner rib flank of the sealing rib rests with a sealing effect against the inner groove flank when the casting melt solidifies in the groove. Additionally or alternatively, the casting head may include a ring-shaped collar, and the collar may include an outer collar flank for forming the casting melt to provide a circumferential, ring-shaped sealing groove such that an outer groove flank of the
(Continued)

sealing groove rests with a sealing effect against the outer collar flank when the casting melt solidifies.

16 Claims, 3 Drawing Sheets

(51) Int. Cl.
*B22D 25/02* (2006.01)
*B22D 27/13* (2006.01)

(56) References Cited

U.S. PATENT DOCUMENTS

| | | | | | |
|---|---|---|---|---|---|
| 6,035,923 | A * | 3/2000 | Oda | B22D 19/14 164/97 |
| 8,011,095 | B2 * | 9/2011 | Sander | B22D 19/0027 29/888.046 |
| 8,770,266 | B2 | 7/2014 | Sasaki et al. | |
| 2004/0057865 | A1 * | 3/2004 | Ikuno | B22D 15/02 420/535 |
| 2015/0204268 | A1 * | 7/2015 | Sasaki | B22D 31/00 123/193.6 |

FOREIGN PATENT DOCUMENTS

| | | | | |
|---|---|---|---|---|
| DE | 19701085 | A1 * | 7/1998 | B22C 9/108 |
| DE | 29924140 | U1 | 3/2002 | |
| DE | 102004052231 | A1 | 5/2006 | |
| DE | 102013206708 | A1 | 10/2013 | |
| EP | 1512862 | A1 | 3/2005 | |
| EP | 01804985 | B1 | 6/2009 | |
| FR | 2237712 | A1 * | 2/1975 | B22D 27/13 |
| GB | 2090780 | A | 7/1982 | |
| JP | 57-32869 | A | 2/1982 | |
| JP | 58086968 | | 5/1983 | |
| JP | S58-86968 | A | 5/1983 | |
| JP | H03-47640 | U * | 5/1991 | |
| JP | H03047640 | U | 5/1991 | |
| JP | 2000-042718 | A | 2/2000 | |
| JP | 2005-061306 | A | 3/2005 | |
| JP | 2009-061501 | A | 3/2009 | |
| JP | 2014109045 | A | 6/2014 | |
| WO | WO-2004105980 | A1 | 12/2004 | |
| WO | 06/045589 | A1 | 5/2006 | |
| WO | WO-2006133914 | A1 | 12/2006 | |

OTHER PUBLICATIONS

Kinetic Die Casting Blog, "What is a Die Casting Draft Angle and Why is it Important?", Dec. 23, 2013, <https://www.kineticdiecasting.com/kdc/what-is-a-die-casting-draft-angle-and-why-is-it-important/>. (Year: 2013).*
English Translation of International Preliminary Report on Patentability related to PCT/EP2015/066598.
English abstract for JP-58086968.
English abstract for JP-57-32869.
German search report for DE-102014216517.2, dated Jan. 15, 2015.
English abstract for DE-102004052231.
Japanese Office Action dated Jan. 8, 2019 related to corresponding Japanese Patent Application No. 2017-505628.
Ding Wenxi, "Engineering Materials and Applications", pp. 156-158, Sinopec Press, Beijing, Aug. 2013.
Chinese Office Action dated Jun. 4, 2019 related to Chinese Patent Application No. 201580042877.X.

* cited by examiner

CASTING TOOL AND METHOD FOR PRODUCING A PISTON FOR AN INTERNAL COMBUSTION ENGINE

CROSS-REFERENCE TO RELATED APPLICATION

This application claims priority to German Patent Application No. 10 2014 216 517.2, filed on Aug. 20, 2014, and International Patent Application No. PCT/EP2015/066598, filed on Jul. 21, 2015, the contents of which are hereby incorporated by reference in their entirety.

TECHNICAL FIELD

The invention relates to a casting tool for producing a piston. The invention furthermore relates to a corresponding method for producing a piston of this kind.

BACKGROUND

Fluid energy machines in which pistons in cylinders perform a periodic translational motion, which is transmitted via connecting rods, are known in mechanical engineering as piston engines. Probably the most widespread type of piston engine is the reciprocating-piston engine, which converts the change in the volume of a gas into the described linear motion of the piston and, via a connecting rod and a crank, furthermore converts the latter into a rotary motion. In what is probably the most common variant of the piston engine, the internal combustion engine, the piston has a combustion recess for this purpose.

According to the prior art, suitable pistons are normally produced by means of a forming process, in particular by means of specialized casting techniques. Permanent mold casting, which is known from metal processing, in which a melt is cast via a gate at the top into a metal permanent mold known as a die and the cavity of which fills essentially by gravity alone or by virtue of external pressure application, has proven particularly suitable.

Compensating the extremely high thermal load which occurs during the operation of the engine in the edge region of the combustion recess, which can lead in unfavorable circumstances to the formation of cracks in the piston, has proven problematic here. In respect of this problem scenario, the use of cooled ring supports is known from the prior art, for example. The edge of the recess is increasingly also being reinforced by embedding ceramic fibers. The squeeze casting method or a robot-aided medium-pressure diecasting method (RMD) is now being used as a permanent mold casting method for this purpose in order to ensure complete infiltration of the ceramic fibers by the molten aluminum and thus to promote the incorporation of the ceramic fibers into the metal structure.

A corresponding method is known from DE 10 2004 052 231 A1 and the corresponding disclosure in EP 1804 985 B1. Both documents relate to a method for the series production of a piston, wherein a casting melt is introduced via a feed region into a multi-part casting mold having a casting head and at least one feeder, wherein it is envisaged that, after the casting of the piston blank, the opening of the upwardly open end of the feeder sleeve is subjected to a gas pressure acting on the casting melt. The leaktightness of the feeder is ensured by using a "collar feeder". One embodiment of this method is characterized in that, after the filling of the piston casting tool, the formation of an edge shell formed by solidified casting melt is awaited. A special embodiment of the casting head and feeder sleeve leads to the formation of a collar around the feeder in this solidification phase, giving rise to a sealing surface between the mouthpiece of the feeder and the collar, which holds the feeder contents in position.

One critical factor here is found to be leaktight pressurization of the feeder materials, which are generally composed of thermally insulating and mechanically weak materials, such as ceramics. The formation of an edge shell in the feeder takes place functionally with a delay relative to the casting tool.

SUMMARY

It is therefore the underlying object of the invention to provide an improved casting tool in such a way that high-quality pistons can be produced in a robust casting process for pistons.

According to the invention, this problem is solved by the subject matter of the independent claim(s). Advantageous embodiments form the subject matter of the dependent claim(s).

Accordingly, the invention is based on the fundamental concept of adding to a casting head used in the context of the casting method, a preferably ring-shaped groove running around the feeder or a preferably ring-shaped collar running around the feeder, the groove or collar furthermore being arranged at a radial distance from the feeder. The casting melt fed into the casting mold via the feeder or an inlet can solidify in this groove, for example, to form a circumferential sealing rib, the inner flank of which rests with a sealing effect against a corresponding inner flank of the groove. During solidification, the casting shrinks onto the groove flank, especially in the case of different thermal expansion coefficients, such as those between an aluminum melt and a steel die. In the case of a head mold which is typically formed from steel, the high thermal conductivity of the steel brings about rapid cooling and solidification of the melt at the contact points, and this can lead to directional solidification with the formation of a fine microstructure solidified in the form of columnar grains. The still molten part of the casting melt is held in position and prevented from emerging prematurely from the head die by the surface contact between the two flanks, even in the preferred but not essential case of pressurization of the melt via the feeder. The groove surface furthermore acts as a pressure tight surface during pressurization via the feeder. This is advantageous particularly if the melt in the feeder has not yet formed a stable edge shell, owing to the good thermal insulation of the feeder material, and hence the molten melt can infiltrate porous inserts, e.g. for recess edge reinforcement, by virtue of the pressurization via the feeder. While pressurization of the melt, particularly during infiltration of porous inserts, has proven advantageous and is preferred, the formation of a combustion chamber recess in a shrunk-on workpiece can also take place without pressurization and, according to the invention, can bring about directional solidification by rapid cooling.

Of particular advantage in the casting tool according to the invention is the fact that the circumferential groove or the circumferential collar is at a radial distance from the feeder and arranged separately from the latter, with the result that the feeder per se is not stressed by the shrinking on of the casting melt during the solidification of the casting melt, as is the case, for example, with the feeder in DE 10 2004 052 231 A1.

In this case, the casting tool according to the invention for a piston comprises the casting mold mentioned for forming the piston from the casting melt, the casting head with the centrally arranged feeder for feeding the casting melt into the casting mold, and a pressurized gas line opening into the feeder for the purpose of compressing the casting melt within the casting mold. The preferably ring-shaped, in particular circular ring-shaped, groove running around the feeder and at a radial distance therefrom, and/or the preferably ring-shaped, in particular circular ring-shaped, collar running around the feeder and at a radial distance therefrom, is/are optionally provided here in the casting head. The groove has an inner groove flank for forming the casting melt into a ring-shaped sealing rib in such a way that an inner rib flank of the sealing rib rests with a sealing effect against the inner groove flank when the casting melt solidifies in the groove, whereas the collar has an outer collar flank for forming the casting melt into a ring-shaped sealing groove in such a way that an outer groove flank of the sealing groove rests with a sealing effect against the outer collar flank when the casting melt solidifies. Common to those complementary embodiments is the fact that there is no load on the feeder, in particular the feeder collar as known from DE 10 2004 052 231 A1, during solidification of the casting melt, and there is no premature solidification in the feeder.

To achieve an advantageous lightweight design of the piston, the use of a suitable aluminum alloy may be considered as a casting melt, for instance. Through the selection of specific alloying elements, which are introduced into the aluminum liquefied by melting, it is possible to selectively influence properties such as hardness, vibration absorption, toughness and the machinability of the piston blank for mechanical processing.

Because of its low viscosity, low shrinkage and other positive casting properties, an aluminum-silicon alloy, for example, has proven suitable as a light-metal casting melt, having its eutectic composition at a silicon content of approximately 12% by weight. Either a hypoeutectic or a slightly hypereutectic mixing ratio is recommended here for the method proposed, giving the resulting aluminum alloy a solidification region in which, in addition to the casting melt, there is already a small proportion of solid phases as well. In this way, the sealing effect according to the invention of the solidifying rib is achieved at an early stage. Adding up to 6% by weight of copper, up to 3% by weight of nickel and up to 1% by weight of magnesium may also be regarded as expedient for additionally increasing the strength of the piston blank. In all cases, the proportions of alloy are given in percent by weight.

The invention is furthermore based on the general concept, in the case of a method for producing a piston by means of a multi-part casting tool, of introducing a casting melt via a separate inlet of the casting tool, wherein the casting melt is subjected to pressure within the casting head by means of a pressurized gas line opening into the feeder. In this case, the missing volume due to the shrinkage of the solidifying melt and the infiltration of any porous inserts that are present is supplied to the casting mold from the feeder. During this process, the casting melt solidifies into a ring-shaped sealing rib in a groove running around the feeder in the casting head and at a radial distance therefrom, such that an inner rib flank of the sealing rib rests with a sealing effect against an inner groove flank of the groove of the piston casting tool. As an alternative, it is also possible to provide a collar on the casting head instead of the groove or in addition to the latter, with the result that the casting melt solidifies at this circumferential collar at a radial distance from the feeder to give a ring-shaped sealing groove, such that an outer groove flank of the sealing groove rests with a sealing effect against an outer collar flank of the collar of the piston casting tool. Common to both embodiments is the fact that no mechanical load is imposed on the feeder by a shrinking-on process during solidification of the casting melt; instead, the shrunk-on casting is supported directly on the casting head by a pressure force exerted via the sealing surface and, at the same time, brings about sealing along the sealing surface.

A particularly advantageous embodiment is obtained if the collar of the head mold is already as close as possible in its contours to the shape of the subsequent combustion recess, in particular of the recess edge and neck. By introducing cooling passages in the casting head close to the groove or the collar and by appropriate cooling in conjunction with the surface contact at the sealing surface under the shrinkage pressure, the removal of heat from the melt can be accelerated. In the surroundings of the contact surface, this leads to an improved character of the microstructure and, as a result, to higher quality of the casting by virtue of the accelerated solidification. Moreover, the more rapid solidification allows earlier pressurization for better infiltration of porous inserts.

In a preferred embodiment, the proposed production method is carried out as a gravity diecasting or low-pressure casting method under a pressure of between 0.3 bar and 20 bar. With a reduced space requirement compared with sand casting methods for a similar purpose, substantially full mechanization by means of suitable robots is made possible in this way, allowing a considerable increase in casting output.

Further important features and advantages of the invention will become apparent from the dependent claims, from the drawings and from the associated description of the figures with reference to the drawings.

It goes without saying that the features mentioned above and those which remain to be explained below can be used not only in the respectively indicated combination but also in other combinations or in isolation without exceeding the scope of the present invention.

Preferred illustrative embodiments of the invention are shown in the drawings and are explained in greater detail in the following description, wherein identical reference signs refer to identical or similar or functionally identical components.

DETAILED DESCRIPTION

Figure 1:
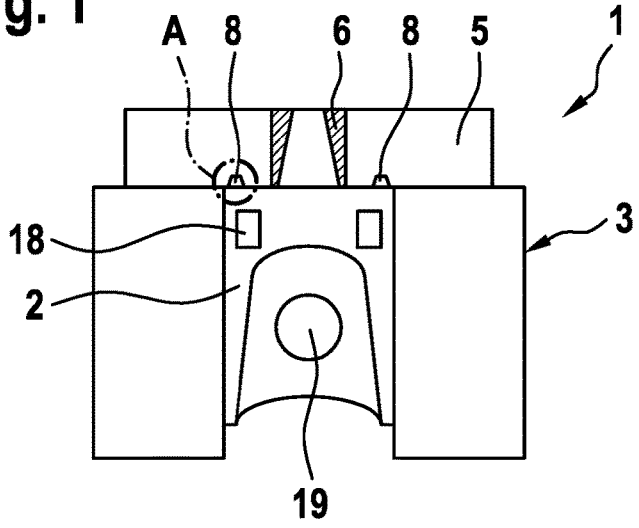
FIG. 1 shows a section through a casting tool according to the invention in accordance with a first embodiment, having a groove situated radially on the outside in the casting head of the piston casting tool.
Figure 2:
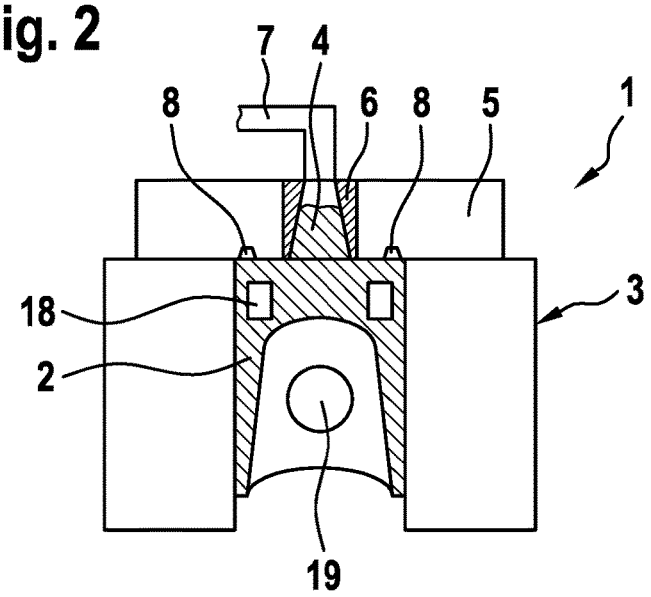
FIG. 2 shows a section through a casting tool according to the invention in accordance with a second embodiment, having a groove situated radially on the inside in the casting head of the piston casting tool.

As shown in FIGS. 1 to 3 and 5 to 8, a casting tool 1 according to the invention for a piston 2 has a casting mold 3 for forming the piston 2 from a casting melt 4 (cf. FIG. 2). The casting mold 3 has a casting head 5 having a preferably centrally arranged feeder 6 for feeding the casting melt 4 into the casting mold 3, and a pressurized gas line 7 opening into the feeder 6 for the purpose of compressing the casting melt 4 within the casting mold 3 (cf. FIG. 2). The feeder can be formed from ceramic material, for example. According to the invention, a groove 8 arranged in the casting head 5, running in a ring shape around the feeder 6 and at a radial distance therefrom is provided, having an inner groove flank 9 (cf. FIG. 4*a*) for forming the casting melt 4 into a circumferential ring-shaped sealing rib 10 in such a way that an inner rib flank 11 of the sealing rib 10 rests with a sealing effect against the inner groove flank 9 when the casting melt 4 solidifies in the groove 8. As an alternative (or in addition) thereto, it is also possible to provide an annular collar 12 arranged in the casting head 5, running in a ring shape around the feeder 6 and at a radial distance therefrom (cf. FIGS. 3, 7 and 8), having an outer collar flank 13 for forming the casting melt 4 into a ring-shaped sealing groove 14 in such a way that an outer groove flank 15 of the sealing groove 14 rests with a sealing effect against the outer collar flank 13 when the casting melt 4 solidifies and shrinks. This has the major advantage that the feeder 6 is not subjected to a load by shrinkage of the casting melt 4 as the casting melt 4 solidifies. At the same time, premature separation of the piston 2 is prevented. After the removal of the piston 2 from the mold, the sealing rib 10 and the sealing surfaces of the sealing groove 14 are removed by turning during the production of the final shape of the piston head.

Figure 3:
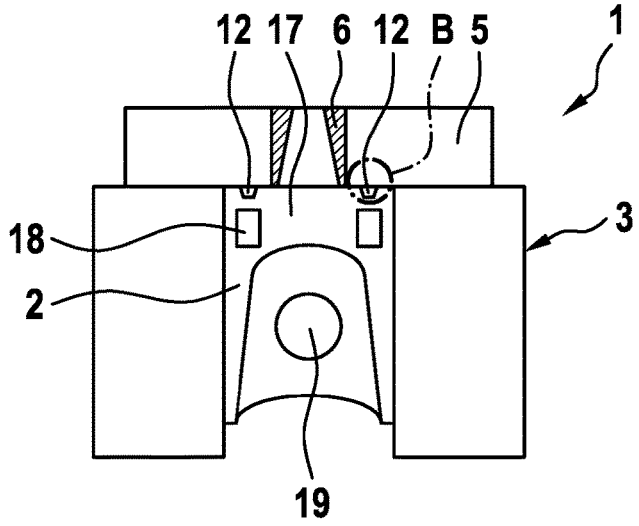
FIG. 3 shows a section through a casting tool according to the invention in accordance with a third embodiment, having an annular collar situated radially on the outside in the casting head of the piston casting tool, wherein the annular collar can also be formed on the inside, similarly to FIG. 2.
Figure 4:
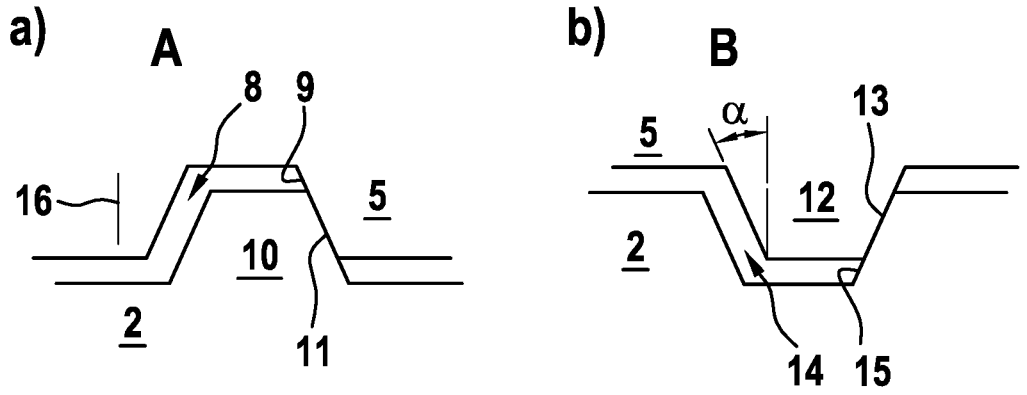
FIG. 4A shows a detail A from FIGS. 1 and 2.
FIG. 4B shows a detail B from FIG. 3.
Figure 5:
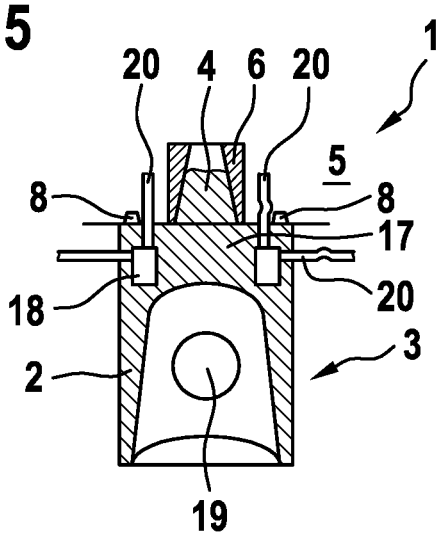
FIG. 5 shows an illustration like that in FIG. 1 but with a porous insert.
Figure 6:
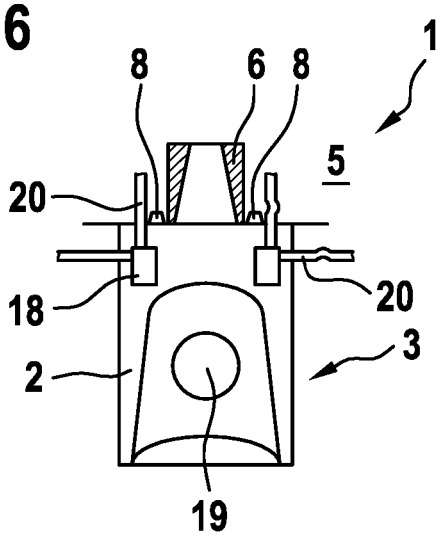
FIG. 6 shows an illustration like that in FIG. 2 but with a porous insert.
Figure 7:
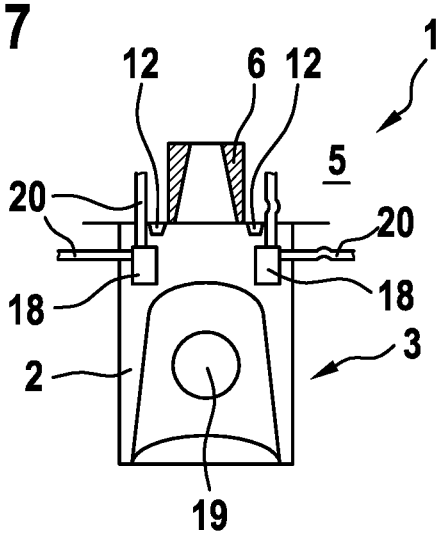
FIG. 7 shows an illustration like that in FIG. 3 but with a porous insert.

According to FIG. 1 and FIG. 5, the groove 9 or the collar 12 is arranged radially on the outside, whereas, according to FIGS. 2 and 6, it is arranged radially on the inside, i.e. is at a shorter radial distance from the feeder 6 than the groove 9 shown in FIGS. 1 and 5. As an alternative, it is, of course, also possible to provide an annular collar 12 instead of the groove 9, as illustrated in FIGS. 3 and 7. Here too, it is conceivable for the annular collar 12 to be arranged further out or further in, although there is always a spacing with respect to the feeder 6.

In this case, the groove flank 9 or the collar flank 13 can have a slope angle $\alpha$ of between 3° and 20°, preferably from 10° to 15°, relative to a perpendicular 16 to a surface of the casting head 5. On the one hand, the slope angle $\alpha$ selected should be small enough, with regard to the friction coefficients, to ensure reliable retention of the shrunk-on casting on the sealing surface. On the other hand, the slope angle $\alpha$ should still be sufficiently large to allow easy removal of the fully cast piston 2. This geometrical configuration furthermore ensures that, for its part, the sealing rib 10 or sealing groove 14 formed after the hardening of the casting melt 4 defines an inner rib flank 11 or outer groove flank 15 which rests flat against said inner groove flank 9 or outer collar flank 13 and thus seals off the casting head 5 or head die against premature and unwanted escape of the casting pressure and hence allows correct infiltration of the porous inserts.

By means of the casting tool 1, a piston 2 can be produced as follows: first of all, the casting melt 4 is fed via the inlet 21 into the casting head 5 and, via the latter, into the casting mold 3 of the casting tool 1, wherein the casting melt 4 is subjected to pressure within the casting head 5 by means of the pressurized gas line 7 opening into the feeder 6 in order to avoid the formation of shrinkage cavities and in order to infiltrate porous cast-in parts. As the casting melt 4 is poured into the casting mold 3, it also enters the groove 8 running in a ring shape around the feeder 6 in the casting head 5 and at a radial distance therefrom and solidifies to form a ring-shaped sealing rib 10, wherein the respective inner rib flank 11 of the sealing rib 10 rests leaktightly against the inner groove flank 9 of the groove 8 (cf. FIGS. 1, 2, 4*a*, 5 and 6). As an alternative, the casting melt 4 can also solidify in such a way at the annular collar 12 running in a ring shape around the feeder 6 in the casting head 5 and at a radial distance therefrom, forming a ring-shaped annular sealing groove 14, that an outer groove flank 15 of the sealing groove 14 rests with a sealing effect against the outer collar flank 13 of the annular collar 12.

In this case, the casting melt 4 should be subjected to pressure after the filling of the casting mold 3 and before the complete solidification of the casting melt, at the earliest after the filling of the casting mold 3 and after the partial solidification of an edge shell of the piston and partial areas of the inlet 21. In order to be able to reinforce regions subject to particularly high loads, e.g. a recess edge 17 or a ring support region of the piston, provision can be made to insert a porous insert 18 at that point (cf. FIGS. 5 to 8). Moreover, the piston can contain further inserts that do not require infiltration, e.g. ring supports or salt cores for the formation of cooling passages.

The insert 18, in particular a ring support or a recess edge protector, can, for example, be porous and infiltrated by means of pressure exerted on the casting melt 4. At the same time, infiltration can be assisted by the production of a vacuum by means of suction lines 20. A near-eutectic aluminum alloy containing 10% to 14% by weight of silicon and/or furthermore up to 6% by weight of copper, up to 3% by weight of nickel and/or up to 1% by weight of magnesium is particularly suitable for the casting melt 4. Moreover, it is possible, for the purpose of increasing hot strength, to add further elements, e.g. V and Zr (in each case <0.2%), and, for grain refinement, Ti (<0.2%) and P (<0.01%), for example. A near-eutectic or even hypoeutectic configuration of the AlSi alloys has proven advantageous in terms of suitability for infiltrating porous inserts. Moreover, there is a preference for a casting melt which is largely free from impurities due to low-melting elements with a melting point <490° C., e.g. Pb, Bi, Sn, Zn, wherein the concentrations of these elements individually are each below 0.01%.

Casting of the pistons 2 is performed by the gravity diecasting or low-pressure casting method, and solidification of the casting melt in the casting mold takes place, in particular, under a pressure of between 0.3 bar and 20 bar.

In a manner known per se, the casting melt 4 described is introduced into the casting tool 1 via the inlet 21, with the result that the free regions of the casting mold 3 around a core 19, which subsequently forms the small end bearing eye of the piston 2, fill up all around with casting melt 4. The specific embodiment of the casting head 5 and the feeder 6 allows the formation of the sealing rib 10 or sealing groove 14 holding the feeder contents in position when, to achieve short cycle times, the casting tool is opened in accordance with the method at a time at which the contents of the feeder 6 may still be partially liquid internally. In this case, the stabilizing effect of the sealing rib 10 or sealing groove 14 is assisted by the groove 8 essential to the invention surrounding the feeder 6 in the casting head 5 or, in the complementary embodiment, by the annular collar 12, within which the casting melt 4 solidifies to form the ring-shaped sealing rib 10 or sealing groove 14.

Figure 8:
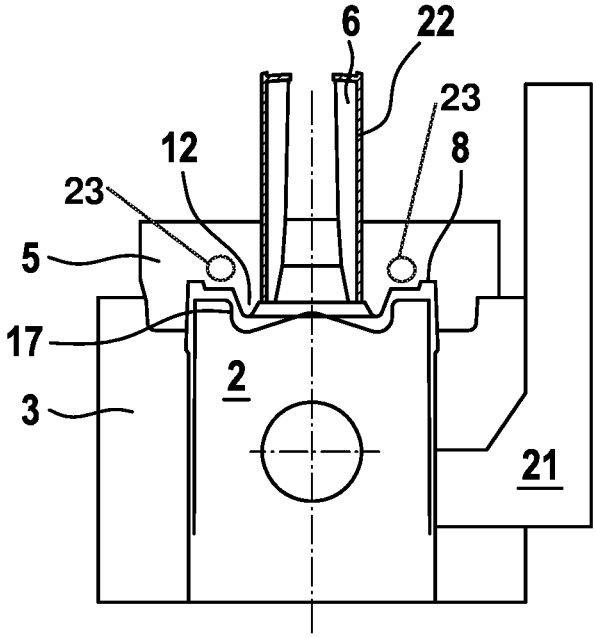
FIG. 8 shows an illustration similar to that in FIG. 3 with an annular collar in the casting head, in which a recess shape precast by means of the annular collar is depicted.

For this purpose, the casting melt 4 can rise to a desired extent within the feeder 6, giving rise to a free space within the feeder 6 above the introduced casting melt 4 after feeding of casting melt 4 has ended, via which free space the casting melt 4 can be subjected to a gas pressure of between 0.3 bar and 20 bar. It has proven advantageous to configure the casting head 5 of the piston casting tool 1 in such a way that the feeder 6 is guided at the outside diameter in the casting head 5 by a sleeve 22, to which the pressure line 7 is flanged in a pressure tight manner. The gas for pressurization is fed to the feeder 6 via the pressurized gas line 7, which is open to the environment during the process of introducing the casting melt 4, thus allowing pressure equalization to take place (cf. FIG. 2). For the sake of simplicity, the pressurized gas line 7 is depicted only in FIG. 2, and the inlet 21 and the sleeve 22 are depicted only in FIG. 8, while it is clear that they can also be present in other embodiments. As shown in FIG. 8, the casting head 5 may have cooling passages 23 arranged to carry a cooling medium in a region of the groove 8 and/or the collar 12 for cooling the groove 8 and/or the collar 12.

The invention claimed is:

1. A method for producing a piston, comprising:

introducing a casting melt into a casting head of a casting tool via an inlet;

casting the casting melt, wherein casting the casting melt includes at least one of:

forming the casting melt into a ring-shaped sealing rib via a ring-shaped groove of the casting tool that extends around a feeder of a thermally insulating material in the casting head at a radial distance therefrom, such that upon solidification of the casting melt an inner rib flank of the sealing rib rests with a sealing effect against an inner groove flank of the groove, wherein forming the casting melt into the ring-shaped sealing rib includes contacting the casting melt with the inner groove flank having a slope angle of 10° to 15° relative to a perpendicular to a surface of the casting head to facilitate sealing the casting melt along the inner rib flank; and forming the casting melt to provide a ring-shaped sealing groove via a ring-shaped collar of the casting tool that extends around the feeder in the casting head at a radial distance therefrom, such that upon solidification of the casting melt an outer groove flank of the sealing groove rests with a sealing effect against an outer collar flank of the collar, wherein forming the casting melt into the ring-shaped sealing groove includes contacting the casting melt with the outer collar flank having a slope angle of 10° to 15° relative to a perpendicular to a surface of the casting head to facilitate sealing the casting melt along the outer groove flank;

inserting at least one porous insert into a casting mold of the casting tool, and infiltrating the at least one porous insert with the casting melt via exerting a pressure on the casting melt, wherein infiltrating the at least one porous insert includes providing a negative pressure via suction lines leading to the at least one porous insert to facilitate infiltration with the casting melt; and guiding the feeder in the casting head via a sleeve coupled to the casting head, the sleeve extending through the casting head from an interior of the casting mold outwards beyond the casting head, and wherein a pressurized gas line is coupled to the sleeve in a pressure tight manner for pressurizing the casting melt.

2. The method as claimed in claim 1, further comprising cooling at least one of the groove and the collar by circulating a cooling medium through at least one passage arranged in the casting head in a region of the at least one of the groove and the collar.

3. The method as claimed in claim 1, further comprising compressing the casting melt within the casting head.

4. The method as claimed in claim 3, wherein compressing the casting melt includes providing a casting pressure of between 0.35 bar and 20 bar after filling the casting mold with the casting melt and after partial solidification of the casting melt.

5. The method as claimed in claim 3, wherein compressing the casting melt includes pressurizing the casting mold via the pressurized gas line that opens into the feeder to exert the pressure on the casting melt for infiltrating the at least one insert with the casting melt while providing the negative pressure via the suction lines to facilitate infiltration.

6. The method as claimed in claim 1, wherein the casting melt includes molten aluminum containing 10% to 14% by weight of silicon and at least one of up to 6% by weight of copper, up to 3% by weight of nickel and up to 1% by weight of magnesium.

7. The method as claimed in claim 6, wherein a percentage of impurities present in the casting melt, defined by one or more low-melting elements with a melting point <490° C., is in each case less than 0.01%.

8. The method as claimed in claim 1, wherein casting the casting melt includes one of gravity diecasting and low-pressure diecasting.

9. The method as claimed in claim 1, wherein the casting melt includes molten aluminum containing 10% to 14% by weight of silicon.

10. The method as claimed in claim 1, wherein casting the casting melt includes forming the casting melt into the ring-shaped sealing rib via the ring-shaped groove, and further including compressing the casting melt via a pressurized gas within the casting head.

11. The method as claimed in claim 1, wherein casting the casting melt includes forming the casting melt to provide the ring-shaped sealing groove via the ring-shaped collar, and further including compressing the casting melt via a pressurized gas within the casting head.

12. The method as claimed in claim 5, wherein introducing the casting melt into the casting head includes communicating a free space within the feeder with an external environment via the pressurized gas line for pressure equalization.

13. The method as claimed in claim 1, wherein casting the casting melt includes both of forming the casting melt into the ring-shaped sealing rib via the ring-shaped groove and forming the casting melt to provide the ring-shaped sealing groove via the ring-shaped collar.

14. The method as claimed in claim 13, wherein the ring-shaped collar is disposed on the casting head radially inwards of the ring-shaped groove, and wherein the ring-shaped collar is arranged separately from the feeder.

15. A method for producing a piston, comprising:

introducing a casting melt into a casting head of a casting tool via an inlet;

casting the casting melt, wherein casting the casting melt includes at least one of:

forming the casting melt into a ring-shaped sealing rib via a ring-shaped groove of the casting tool that extends around a feeder in the casting head at a radial distance therefrom, wherein forming the casting melt into the ring-shaped sealing rib via the ring-shaped groove includes contacting the casting melt with an inner groove flank of the ring-shaped groove having a slope angle of between 3° and 20° relative to a perpendicular to a surface of the casting head to facilitate sealing along the inner groove flank and an inner rib flank of the sealing rib upon solidification of the casting melt; and forming the casting melt to provide a ring-shaped sealing groove via a ring-shaped collar of the casting tool that extends around the feeder in the casting head at a radial distance therefrom, wherein forming the casting melt to provide the ring-shaped sealing groove via the ring-shaped collar includes contacting the casting melt with an outer collar flank of the ring-shaped collar having a slope angle of between 3° and 20° relative to a perpendicular to a surface of the casting head to facilitate sealing along the outer collar flank and an outer groove flank of the sealing groove upon solidification of the casting melt; and guiding the feeder in the casting head via a sleeve coupled to the casting head, the sleeve extending through the casting head from an interior of the casting mold outwards beyond the casting head.

16. The method as claimed in claim 15, wherein casting the casting melt includes both of forming the casting melt into the ring-shaped sealing rib via the ring-shaped groove and forming the casting melt to provide the ring-shaped sealing groove via the ring-shaped collar, and wherein the ring-shaped collar is arranged separately from the feeder.

* * * * *